US009079682B2

(12) United States Patent
Adams

(10) Patent No.: US 9,079,682 B2
(45) Date of Patent: Jul. 14, 2015

(54) BAKERY BOXES HAVING REMOVABLE PARTS COMPRISING PLATES AND OTHER TABLEWARE

(71) Applicant: Phyllis Adams, Cary, MS (US)

(72) Inventor: Phyllis Adams, Cary, MS (US)

( * ) Notice: Subject to any disclaimer, the term of this patent is extended or adjusted under 35 U.S.C. 154(b) by 97 days.

(21) Appl. No.: 13/646,930

(22) Filed: Oct. 8, 2012

(65) Prior Publication Data

US 2014/0097235 A1 Apr. 10, 2014

(51) Int. Cl.

| | |
|---|---|
| ***B65D 5/42*** | (2006.01) |
| ***B65D 77/24*** | (2006.01) |
| ***B65D 81/36*** | (2006.01) |
| ***B65D 85/36*** | (2006.01) |

(52) U.S. Cl.

CPC *B65D 5/42* (2013.01); *B65D 77/24* (2013.01); *B65D 81/36* (2013.01); *B65D 85/36* (2013.01)

(58) Field of Classification Search

CPC ..... B65D 5/42; B65D 77/24; B65D 81/36; B65D 85/36

USPC ..... 229/103, 162.3

See application file for complete search history.

(56) References Cited

U.S. PATENT DOCUMENTS

| | | | | |
|---|---|---|---|---|
| 3,207,411 | A * | 9/1965 | Farquhar | 229/162.3 |
| 4,380,289 | A * | 4/1983 | Bigelow | 206/216 |
| 6,527,123 | B1 * | 3/2003 | Ausaf | 206/549 |
| 2002/0134827 | A1 * | 9/2002 | Sinclair et al. | 229/240 |
| 2003/0209592 | A1 * | 11/2003 | Lawrence Holden | 229/103 |
| 2005/0211756 | A1 * | 9/2005 | McLaughlin | 229/162.3 |
| 2006/0191983 | A1 * | 8/2006 | Cargile, Jr. | 229/103 |
| 2006/0226206 | A1 * | 10/2006 | Reap | 229/103 |
| 2009/0058003 | A1 * | 3/2009 | Nouhan, Jr. | 273/260 |
| 2009/0114708 | A1 * | 5/2009 | Sung et al. | 229/120 |
| 2010/0001051 | A1 * | 1/2010 | Castiglioni et al. | 229/103 |
| 2010/0059579 | A1 * | 3/2010 | House | 229/120 |

* cited by examiner

*Primary Examiner* — Gary Elkins
(74) *Attorney, Agent, or Firm* — Ian P. Coyle

(57) ABSTRACT

The invention provides improved bakery boxes comprising removable plates and other tableware. Said removable tableware may comprise scored or perforated subpanels imparted in panels of a box, and alternatively, may comprise separately manufactured tableware reversibly attached to panels of a box. The invention further provides compound panels having expanded surface areas for accommodating greater quantities of removable subparts in diverse materials, shapes, and sizes. The invention emphasizes the placement of said removable tableware within superfluous panels that are not essential to the structural and functional integrity of the box, so therefore the food storage utility of the box is not necessarily destroyed when the tableware is removed, said superfluous panels comprising, for example, overlapping panels on the sides of a box or cellophane-reinforced panels in windowed boxes.

15 Claims, 3 Drawing Sheets

BAKERY BOXES HAVING REMOVABLE PARTS COMPRISING PLATES AND OTHER TABLEWARE

BACKGROUND OF THE INVENTION

1. Field of the Invention

The present invention relates generally to food storage containers, and more specifically to bakery boxes that incorporate removable plates and other tableware within various panels and parts of said bakery boxes.

2. Description of the Related Art

The following review of related art is intended to provide edifying examples of problems and pitfalls in the design and use of food storage containers from which independently useful subpanels and subparts can be extracted. The mention of these examples does not constitute an admission that any of the following methods or devices constitute prior art applicable to the present invention. The discussion of the references states what their authors assert, and the applicant reserves the right to challenge the accuracy and pertinency of any of the documents cited herein.

Consumers commonly purchase food items from bakeries, restaurants, pizzerias, and related vendors in which one or more of said food items are provided in a disposable container. Traditional food storage containers (e.g., cardboard pizza boxes, paperboard bakery boxes) function primarily to protect their food contents during storage and delivery. Some serve secondarily as decorative displays or advertising platforms. Food containers can protect their food contents in several ways, such as: by shielding the enclosed food items from unsanitary exposure to the environment, by protecting the food items from physical damage during handling or storage, by insulating the temperature of the food items, by providing a convenient means for transporting and delivering food items, and by providing temporary storage for the food items before and after serving.

In the pizzeria industry, manufacturers have incorporated perforations into the top and bottom panels of pizza boxes so that a consumer can disassemble the perforated panels into makeshift serving mats resembling "plates." U.S. Pat. No. 7,051,919 to Walsh, filed Aug. 22, 2003, entitled "Convertible Pizza Box" is characteristic of pizza boxes that can be deconstructed into smaller boxes and/or flat serving platters. The Walsh invention comprises a cardboard blank (i.e., a piece of material cut and scored to conveniently fold into a box of specific dimensions) comprising a top portion and a bottom portion and intervening side portions which are folded to form a pizza box of standard dimensions. Either the top or bottom portions can be manually torn from the blank and folded on itself to yield tapered sub-boxes, or they can be torn into individual serving segments (makeshift "plates") defined by score lines (i.e., perforations). The individual serving segments are flat and shaped as squares or triangles. Importantly, the original box is necessarily consumed (destroyed) when the user extracts from it either a sub-box or individual serving segments. U.S. Pat. No. 5,110,038 to Pantisano et. al, filed Apr. 16, 1991, entitled "Plate Forming and Break Down Pizza Box" provides similar features, only it deconstructs into round plates that can be torn or punched out of a top panel, plus it has perforations in the bottom panel to facilitate the breakdown of the box for easy disposal in a household trashcan. This invention further comprises a non-porous surface on the inside panel to prevent pizza grease from soaking through the punch-out serving segments, and for the manual creation of "rim bends" in the circular serving segments to partially mimic the beveled edges of actual plates. U.S. Pat. No. 5,476, 214 to Fisk, Jr., filed Nov. 28, 1994, entitled "Pizza Box with Wedge-Shaped Break-Down Spatula Plates" provides a pizza box with a top panel that breaks down into a number of spatula-type trapezoidal plates. Instead of being cut directly into the box top, the perforated panel can also be included separately within the box as an inserted leaf under the top panel or above the bottom panel.

A major drawback of these inventions is that the perforations which yield the "plates" are positioned in the top and bottom panels of the pizza box, and therefore, the act of extracting the "plates" destroys the pizza box. Pizza is often consumed while hot and fresh and in a single sitting, so the destruction of the box is tolerable to a pizza consumer. However, this result is unsuitable for cakes and various pastries which are often eaten over many days during which the leftovers must be stored. Another drawback of the prior art is that perforations divide the top and bottom weight-bearing panels of the box and thereby weaken the integrity of the box, increasing the risk of a box inadvertently folding or tearing while the food item is inside. Cakes and pies can be heavier and more fragile than pizzas, making these pizza box innovations unsuitable for application to bakery boxes. A further shortcoming in the prior art is that serving platters directed towards pizza consumers provide a very limited benefit, since pizzas are typically eaten right out of the box, by hand, without plates or utensils. The combined prior art drawbacks, comprising the time and effort required for hungry patrons to deconstruct a pizza box to extract the serving platters, the added expense of the perforated boxes, the increased risk of accidental box collapse, and the limited utility or demand for pizza serving platters, helps explain why these inventions have not significantly penetrated the marketplace.

Different conditions apply specifically to the bakery industry and related trades (e.g., makers and distributors of pastries, cakes, ice-cream cakes, pies, catered foods, and specialty dessert items). The serving of these and other bakery-related foods typically involves tableware such as a fork or spoon; it often involves ice cream, sauces, frostings, loose condiments and crumbling or otherwise particularly "messy" ingredients that are not suitable for eating by hand; it commonly involves a large or rich food item which will not be completely eaten in one sitting and will therefore leave "leftovers" that require continued storage; it often involves a dessert item that is appropriate for long term storage and intermittent serving; and it often involves food items associated with sentimental occasions where consumers are more likely to assume a slightly higher price to obtain the benefits provided by a convertible box that includes extraneous or bonus features like extractable subpanels comprising plates and tableware in a range of shapes, sizes, construction qualities, and cost values. The prior art fails to provide bakery boxes that are specially adapted to contain such removable, useful subparts.

Bakery boxes have taller sidewalls than pizza boxes. Many varieties of bakery boxes distinctly incorporate windows comprising cellophane glued behind an aperture cut into the top panel and/or a sidewall panel. Windows that contiguously span two or more panels (sides, surfaces) of a box (e.g., the top panel and the front side panel) are sometimes called "wrap around" windows. Bakery boxes are often comprised of a thinner paperboard material compared to pizza boxes and other food storage containers. Common examples of commercially available bakery boxes are displayed on retail websites such as that of "PaperMart" and Mr. "TakeOutBags." Several examples of prior art boxes that are amenable to the modifications claimed in the present invention follow below.

U.S. Pat. App. Pub. No. 2009/0084706 to Keefe, JR., filed Sep. 28, 2007, entitled "Shipping and Display Container with Removable Cover and the Associated Container Blank," the entirety of which is incorporated by reference herein, describes general methods for forming a box from a blank. U.S. Pat. No. 8,083,125 to Vanhoutte, filed Mar. 19, 2008, entitled "Two-Piece Pastry Box," the entirety of which is incorporated by reference herein, describes a box with an extra panel (element 4) attached to the back wall. U.S. Pat. No. 7,464,855 to Glasgow, filed Dec. 29, 2006, entitled "Combo Box and Associated Blank," the entirety of which is incorporated by reference herein, describes a box with an internal compartment derived from additional panels that are included as extensions of the flap that folds to form the front side wall. U.S. Pat. No. 6,581,823 to De Beck filed Jan. 29, 2002, entitled "Pastry Tote with Handles," the entirety of which is incorporated by reference herein, provides an example of a foldable box with extended side panels that include further panels which fold into a handle element. U.S. Pat. No. 6,450,341 to Krupa et al., filed Feb. 9, 2001, entitled "Shipping and Baking Package for Food Items," the entirety of which is incorporated by reference herein, describes one or more panels or trays for holding individual food items intended to be shrink-wrapped for shipping and storage. The boxes of the present invention are intended to serve as an alternative to, or as an addition to, shrink-wrap for the protection, shipping, and storage of food items assorted within such holders and trays. U.S. Pat. No. 4,441,614 to Gulliver, filed Jan. 19, 1983, entitled "Front Loaded and Closed Carton with Hinged Top Cover," the entirety of which is incorporated by reference herein, describes a front loading windowed box with a hingedly attached top panel representing features common in the art of bakery box construction. U.S. Pat. No. 1,927,435 to Derst filed Feb. 23, 1933, entitled "Package for Frosted Cakes," the entirety of which is incorporated by reference herein, provides an example of box having a window in the top panel and including a structural insert that imparts rigidity to the box. U.S. Pat. No. 1,818,908 to Pouchain et al., filed Mar. 5, 1930, entitled "Ventilated Container," the entirety of which is incorporated by reference herein, provides a box with holes for ventilation. Boxes of related dimensions and folding patterns are compatible with the present invention, however, the present invention teaches against ventilation holes. The present invention may contain removable perforated subpanels within the top flap 7 of Pouchain, but not for ventilation and not in conjunction with holes 10 in an adjacent panel 2.

In light of the above, there exists a need for convertible bakery boxes that include plates, utensils, serving accessories, and any other tableware in their construction. Such bakery boxes should be amenable to the incorporation of see-through panels ("windows") as are typically provided in bakery boxes known in the art, and said boxes should yield tableware which can be extracted or removed without necessarily destroying the boxes, thereby permitting their continued use as food storage containers. There exists a need for boxes that can accommodate high quality tableware and tableware comprising a variety of decorative features and disparate material compositions. The state of the art would be further improved if the number and size of subparts derived from a box were not strictly limited by the size and shape of the outer three dimensional geometry of the box.

SUMMARY OF THE INVENTION

The present invention satisfies the above needs. The present invention provides a variety of bakery boxes having plates, serving platters, bowls, serviceware, eating utensils, and other tableware (generally, "tableware") as removable pieces included within the various panels or components that make up said bakery boxes. In a preferred embodiment, the panels and/or subpanels comprising said removable tableware are formed in and derived directly from the material constituting the box, which manufacture is achieved by the application of perforations or score lines in said material. In other embodiments, the removable tableware is exogenous, imparted by a first step of cutting out sections of box panels to accommodate the insertion of certain tableware and a second step of reversibly attaching said tableware in the spaces created by the cut-out sections, thus permitting boxes to incorporate tableware of prefabricated design, elaborate decoration, and disparate material compositions. Advantageously, the present invention provides for the inclusion of removable tableware within those panels of a box which are structurally superfluous panels relative to the integrity and utility of the box as a food storage container, so that removal of tableware from said superfluous panels does not preclude the continued use of the box, where examples of structurally superfluous panels may include lateral flaps that overhang a sidewall panel of a box, a doubly folded sidewall panel, a specially manufactured accessory panel included as an extended flap on any structural panel, and/or complex multiply-folded panels. For boxes in which a window is desirable, superfluous panels may also be provided in or upon panels comprising a cellophane backing, such that the removal of the subpanel does not create a hole through the box but instead reveals an underlying window. These features contribute to several advantageous features of the bakery boxes of the present invention, particularly that (1) the provided tableware may be removed from a box without destroying the structural and functional utility of the box, (2) even before removing said tableware, the rigidity or stability of structurally essential parts of a box, such as the top and bottom panels, is not undesirably compromised by the introduction of score lines or discontinuities in said parts, and (3) by emphasizing the placement of removable tableware within superfluous panels, including complex multiply-folded or compound panels, the boxes have an enlarged capacity with respect to the quantity, diversity, and sizes of tableware they can accommodate.

The invention provides a box of suitable material, such as cardboard or paperboard, and of suitable dimensions, such as approximately 12 inches square and four inches deep, for holding a food item. Larger and smaller boxes, and shapes other than quadrangular (e.g., circular or polygonal) are also provided. A circular box can be considered as having three sides comprising a top, bottom, and lateral side, while square and rectangular boxes comprise six sides. The interior space enclosed by a box of the present invention may be accessible through an access opening, whereby the box may be openable and closeable according to any means known in the art for providing an access opening in a container, such that food items can be inserted and removed through said access opening, and such that said access opening may further comprise a means for reversibly fastening the access opening in a closed position. The access opening is a means for accessing the food item and or/the interior space within a box, and examples of features which may contribute to the structure and function of access openings include but are not limited to: panels on adjacent and/or opposing sides of a blank folded to create hingedly attached sections such that one or more panels can be lifted up or down to open and close the box; panels having means for fastening said panels together, such as interlocking tabs and slots, adhesives, or fasteners; and/or a separate unattached panel or lid which fits over, rests upon, and/or is otherwise removably attached to an open side of the box (e.g., when the box is comprised of more than one piece instead of a single-piece blank, and wherein a distinct piece comprises a removable box top or covering means).

Boxes of the present invention provide plates and other tableware in removable subpanels that can be torn or cut out of one or more side walls, panels, surfaces, flaps, or other parts of said boxes. In a preferred embodiment, the box includes at least one panel that overlaps another panel such that its removal, or the removal of subparts within it, does not destroy the underlying panel. Tableware can thusly be removed from panels of the present invention without creating a hole passing all the way through from the outside to the inside of the box, because an underlying panel remains intact, and therefore the extraction of removable subsections does not destroy the utility of the box as a means for protecting, storing, and transporting food and does not expose the contents of the box directly to the outside environment. The overlapping panel can be referred to as an structurally superfluous panel in this context, with respect to the integrity of the box, because destroying a superfluous panel does not destroy the function of the box as a food storage container. As a corollary, the removal of subpanels from a superfluous panel, wherein said subpanels, for example, may be defined by score lines drawn or cut into the superfluous panel, likewise preserves the structural integrity and the utility of the box and does not expose the contents of the box directly to the outside environment. The utility of a typical bakery box of the prior art is essentially to provide a substantially continuous protective barrier around an enclosed interior space wherein food items are stored. Although bakery boxes are not necessarily characterized as providing an air-tight interior space, they provide a substantially rigid barrier against physical deformation by moderate outside forces, and they provide a fully enclosed interior space that effectively blocks the direct linear ingress or egress of solid matter, unless said matter moves with sufficient force to puncture one or more panels or parts of the box, wherein "solid matter" is anything larger than a crumb. This continuous protective barrier need not be impregnable to be functional, and anyone with an ant problem in their kitchen knows that bakery boxes commonly contain narrow indirect routes of entry between adjacent panels, in corners, and at other minute points which are tolerable for the sake of preserving other conveniences such as low cost, simple construction, light weight, and easy assembly. A continuous protective barrier can be considered satisfactory if, for example, it substantially prevents the flow of air currents into the box, reduces the exchange of moisture between the inside and the outside of the box, effectively excludes airborne debris in the outside environment from being deposited on food in the interior space of the box (where airborne debris includes dust, splattered food, sneezed mucus, and the like), and/or substantially deters the ingress of larger insects like houseflies and cockroaches. The advantageous features of the present invention can be applied as modifications to food storage containers and/or bakery boxes known in the prior art, some of which already provide flaps or overlapping side panels which may qualify as structurally superfluous panels as defined in this disclosure. However, it is desirable to extend and/or enhance such panels according to the various modifications and advantages provided by the present invention. Note that even when the subpanels of the present invention are incorporated into prior art box designs, considerable modification is imparted to the panels by virtue of, for example, the scoring lines necessary to define the removable subparts in those panels, the decorations or coatings applied to surfaces of subpanels, and other modifications described throughout this specification.

In another preferred embodiment of the present invention, a box having one or more "windows," is adapted to contain removable subpanels comprising tableware. "Windows" refers to any clear or substantially transparent panel, section, or portions of panels which permit a person to view the contents of the box while it is closed. Windowed panels are well known in the bakery and food service industries for their use in food storage containers, particularly for cakes, pies, and donuts. Windows are typically located on the top panel and/or front side panel of a box. Said windows are commonly manufactured from a sheet of cellophane, polystyrene, and other transparent or substantially transparent film, which materials may further comprise additives imparting desired physical properties such as temperature tolerance, tensile strength, and clarity. In particular, windowed panels may incorporate films and substances approved for food contact by regulatory agencies such as the FDA. An example of an FDA approved film is Enviro Safe Film, which comprises polystyrene and additives which make the film biodegrade. A sheet of a window may be attached to pre-cut sections of box panels by various adhesives, staples, or any other attachment means known in the art. Embodiments of the present invention that incorporate windowed panels may also incorporate one or more superfluous panels as disclosed in the previous paragraph, or they may provide for removable subpanels fashioned in a different manner, such as fashioned from perforated section within the same panel that includes a windowed section. In some but not all embodiments, the removable tableware elements on a windowed panel of a box may be positioned over the transparent material comprising a window of the panel so that when removed said tableware elements expose a newly formed window area in the panel from which they are extracted.

The forgoing summary has outlined some features consistent with the present invention in order that the following detailed description thereof may be better understood, and in order that the present contribution to the art may be better appreciated. The present invention is not limited in its application, details, or components merely to those set forth in the descriptions and illustrations herein. The present invention resides not merely in any one of the features set forth in this specification, but also in the particular combination of all of the features and improvements claimed. Methods and devices consistent with the present invention are capable of other embodiments. Also, the phraseology and terminology employed herein are for the purpose of description and should not be regarded as limiting unless explicitly stated as such.

DETAILED DESCRIPTION OF THE DRAWINGS

Figure 1:
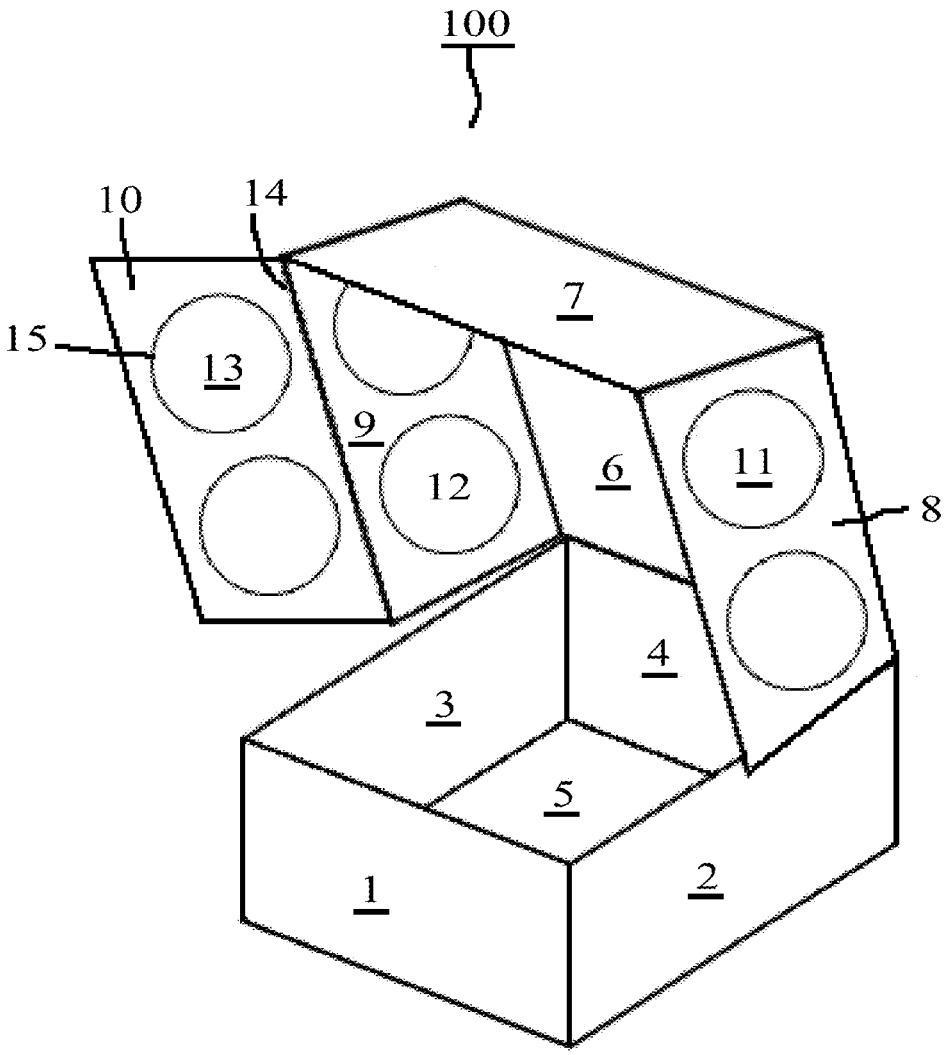
FIG. 1 is a perspective view of a first embodiment of a box of the present invention, in an opened position, comprising removable subpanels defined by score lines, wherein said removable subpanels are circular, and wherein said removable subpanels are located in side flaps descending from the top panel of the box, and wherein one side flap is a compound panel having an attached fold-out panel containing further removable subpanels.

The term "score line" or "scoring line" encompasses any crease, fold, perforations, and/or demarcations provided on a surface or in a material comprising the box, e.g., paperboard or cardboard, for allowing said material to be folded, cut, or torn in a predetermined fashion. Score lines may refer to prefabricated lines imparting a desired degree of weakness to create an edge along which folding can occur, as in a blank that folds into a box, where the degree of said weakness may vary and in some cases (e.g., scoring comprising mere painted lines) no weakness may be imparted. Score lines may include, but are not limited to, indentations, miscellaneous cuts, creases, perforations, through-cut slits, painted lines, and the like. In some instances score lines may be intended to be torn or cut, but not folded, to create detached panels (i.e., removable subpanels), while in other cases score lines may be intended to be folded, unfolded, and refolded many times without substantial loss of integrity in the underlying material into which the score line is demarcated. In the latter cases, such durable re-foldable score lines may be referred to as providing a "hinged" division between adjoining panels, and panels separated by such a fold may be referred to as "hingedly attached" or "hingedly coupled" to each other. Folds, perforations, and other score lines may be applied to the boxes of the present invention using any techniques known in the relevant arts.

A "foldable box" or "collapsible box" refers to any box which takes its shape by folding different segments of a piece of material (e.g., a blank) around score lines, creases, or other predetermined lines. "Unfolded box" generally refers to a blank, while "folded box" or "box" generally refers to the assembled article in its functional 3-dimensional configuration. The "parent box" is jargon for the storage container that features panels and perforations allowing for subpanels and subparts to be derived therefrom. Synonyms that may be used for "parent" in this context are: primary, original, main. "Subparts" or "subpanels" may refer to any of the various removable pieces from any panel or portion of a box. Score lines which define the dimensions and geometry of the parent box may be referred to as "primary folding lines." A "convertible box" may be defined as a box that deconstructs, wholly or partially, to yield subpanels and/or subparts (e.g., tableware such as plates, bowls, utensils, and the like).

The term "bakery box" encompasses any box suitable for the storage, protection, display, and/or transportation of food items commonly associated with bakeries, desserts, catering, and/or special occasions. Other names for bakery box include pastry tote, cake box, donut box, bagel box, pie box, cupcake box, and the like. The term "blank" is used herein according to its common meaning the art, which generally denotes a formable material structured with scored panels such that when properly reconfigured or assembled, which is generally accomplished by manually folding along score lines, it forms a box. A reference to a "blank" can be considered as a simultaneous reference to its corresponding assembled "box" configuration, and vice versa. The formable material for a blank or any box, or for subpanels and individual subparts therein, may comprise any suitable material, including but not limited to cellulose based materials, wood pulp, straw, cotton, paperboard, cane fiber-based paperboard (e.g., Bagasse), cardboards, fiberboards, containerboards, corrugated containerboards, craft paper, coated paper, art paper, duplex board and triplex board, Jute Liner, and the like. Boxes and blanks may have heterogeneous compositions wherein their panels and subparts are differently composed, decorated, and/or treated. Removable subpanels comprising tableware do not necessarily need to be cut from the same original material as the parent panel in which they are mounted, but rather they may be removably attached during manufacture after an appropriately sized hole or sconce has been introduced in said panel to receive the foreign object of the subpanel, for example, during the production of a bakery box blank wherein a plastic dish or wooden utensil is reversibly embedded within a paperboard panel. The manufacture of such embodiments, which can be described as having "exogenous" subpanels, subparts, or pieces may be achieved using any appropriate means for reversibly attaching disparate materials, said means comprising adhesives, staples, interlocking tabs, frangible connecting elements, tongue-in groove fasteners, or any other means for reversibly binding disparate lightweight materials together. A particular combination of materials contemplated for the present invention comprises the use of bamboo and/or other lightweight woods for the box and/or any included subparts. Bamboo and its byproducts, and other lightweight woods or plant materials, are useful as environmentally friendly materials for making sturdy disposable tableware including knives, forks, spoons and any other utensils and dishes.

Environmental conservation and biodegradability are important considerations in the design and use of the present invention. By providing tableware within the panels of food containers the boxes of the present invention reduce waste because material comprising the box is re-allocated for a dual use as tableware, and because the consumer who purchases food in a box of the present invention may avoid buying disposable tableware separately. Boxes may be constructed so as to be fully compostable, biodegradable, and recyclable, such as through incorporation of SFI (Sustainable Forestry Initiative) wood pulp. The inside surface of a panel or subpanel may be coated with an impervious coating such as polyethylene, polypropylene, paraffins, or any material to prevent paper products to enhance the food-contact suitability of subpanels, such as to prevent them from absorbing liquids and oils. Many suitable examples of such coatings are known in the art of manufacturing food storage containers as well as others used in manufacturing disposable plates, bowls, cups, and utensils. Food safe dyes, coatings, and adornments are known in the art which can be used to decorate the box and/or to differentially decorate subparts of a box.

In some embodiments of the present invention, the box is formed of a foldable, one piece blank, although the present invention is not limited in its applicability to only those boxes which are derived from blanks. A blank prefabricated with score lines may be referred to as a "marked-up blank." The formation of a box from a blank may proceed, for example, according to the following common paradigm. A blank comprises a first portion having a perimeter defined by opposing longitudinal side edges, a front edge and a back edge, and a second portion having a perimeter defined by opposing longitudinal side edges, a front edge and a back edge, wherein the second portion is hingedly coupled to the first portion, and a pair of side walls, each coupled, for example hingedly coupled, to one of the opposing longitudinal side edges of the first portion, a front end wall coupled, for example hingedly coupled, to the front edge of the first portion, and a back end wall coupled, for example hingedly coupled, to the back edge of the first portion. Preferably, the blank further comprises additional side walls, each coupled, for example hingedly coupled, to one of the opposing longitudinal side edges of the second portion, an additional front end wall coupled, for example hingedly coupled, to the front edge of the second portion, and an additional back wall coupled, for example hingedly coupled, to the back edge of the second portion. The blank is further structured such that the first portion of the blank may define a cover of the full sized box, and the second portion may comprise a bottom, or base, of the full sized box, or vice-versa. A person of ordinary skill in the art will be familiar with the many ways blanks can be manufactured, marked up, and assembled into boxes.

FIG. 1 is a perspective view of a first embodiment of a box 100 of the present invention defined by six sides comprising six adjacently attached structural panels 1-6. For explanatory purposes, panel 1 is the front panel, 2 is the right side panel, 3 is the left side panel, 4 is the rear panel, 5 is the bottom panel, and 6 is the top panel. Top panel 6 is hingedly attached to rear panel 4, and top panel 6 negatively defines the access opening of the box 100 because it covers said access opening when fully lowered to rest upon side panels 1-3. When the box 100 is closed, structural panels 1-6 define a rectangular, substantially continuous protective barrier surrounding an interior space for storing food. Panels 7-9 are considered to be structurally superfluous flaps here because they overlap panels 1-3, respectively, when the box 100 is in its closed position. Flap 7 is the front flap, 8 is the right side flap, and 9 is the left side flap. If said flaps 7, 8, or 9, or substantial subparts of said flaps 7, 8, or 9, were removed from the box 100, the box 100 would continue to provide a substantially continuous protective barrier around the interior space by virtue of the continued presence of side panels 1, 2, and 3. An optional feature of the present invention is illustrated by extension flap 10, which is hingedly attached to flap 9 by score line 14. Flaps 9 and 10 together comprise a compound panel. One or a plurality of creases like said crease 14 may be imparted, for example, during the original manufacture of the blank, and in the arrangement of FIG. 1, this was achieved by fashioning flap 9 longer than flap 8 in the blank, and then the scored division 14 was subsequently marked and folded to define flap 10. Flap 8 could also contain a foldable extension panel in other embodiments, but the two flaps 8 and 9 have been depicted differently in FIG. 1 to highlight the alternative configurations achievable with the present invention. When the box 100 is closed, flap 10 would be folded over upon flap 9 to lay adjacently flat against flap 9. Other embodiments may contain no extension flaps, and further embodiments may contain more complex extension flaps (e.g., a further flap hingedly attached to the outside edge of flap 10 by yet another crease along their common border; not shown). Flaps 8-10 further comprise scored subpanels 11-13, respectively, which are removable circular subpanels defined by score lines 15 that are tearable perforations. When removed by tearing along the perforated score lines 15, these subpanels 11-13 comprise circular plates. Advantageously, the removal of any subpanels 11-13 does not disrupt the structure or integrity of any of panels 1-6, despite the holes left behind in flaps 8-10 after their removal, thereby preserving the integrity and usefulness of the box 100.

Additional subpanels could also be included in flap 7 or any other panels of the box 100, but these alternatives are omitted from FIG. 1 for simplicity of illustration. For example, in an alternative configuration, the removable subpanels 11 and 12 could have been included within side panels 2 and 3, respectively, instead of in flaps 8 and 9. This alternative arrangement would preserve the shape and protective function of the box 100, after the removal of the hypothetical subpanels from panels 2 and 3, because the non-perforated flaps 8 and 9 would cover the resulting holes when the box 100 is closed, thereby reconstituting the substantially continuous protective barrier around the interior space. In boxes fashioned from thin materials such as paperboard, this alternative arrangement could slightly diminish the integrity of the box 100 since the sides 2 and 3 are part of the inner structure of the box 100, however this drawback can be minimized in several ways, such as by reinforcing the side panels with additional layers of material, by defining smaller subpanels so that less material is removed from the side panels when the subpanels are removed, by distributing the subpanels farther apart from each other with respect to their positions in the side panels, by defining subpanels in shapes other than circular, and other techniques that circumvent and/or compensate for the creation of critical points of weakness in any panel of the box upon removal of its subpanels. Such an alternative design is suitable for lightweight food items but is less desirable for heavy food items like cakes. In a further variation of the arrangement of removable subpanels achievable in the embodiment of FIG. 1., removable subpanels can be included both in the side flaps 7 or 9 and their corresponding/underlying side panels 2 or 3, but they are positioned in a staggered distribution such that their removal cannot create aligned holes through both of the overlapping panels on any side of the box 100 and thus cannot create a full breach in the substantially continuous protective barrier of the box 100. The means for reversibly fastening box 100 in the closed position (not shown) in FIG. 1 is a simple 1-inch long piece of scotch tape affixed to the outside surface of panel 7, wrapping over the edge of panel 7, and attaching to the underside of bottom panel 5. A person of ordinary skill in the art will appreciate that any other fastening means can be appropriately incorporated into any and all embodiments of the present invention.

Figure 2:
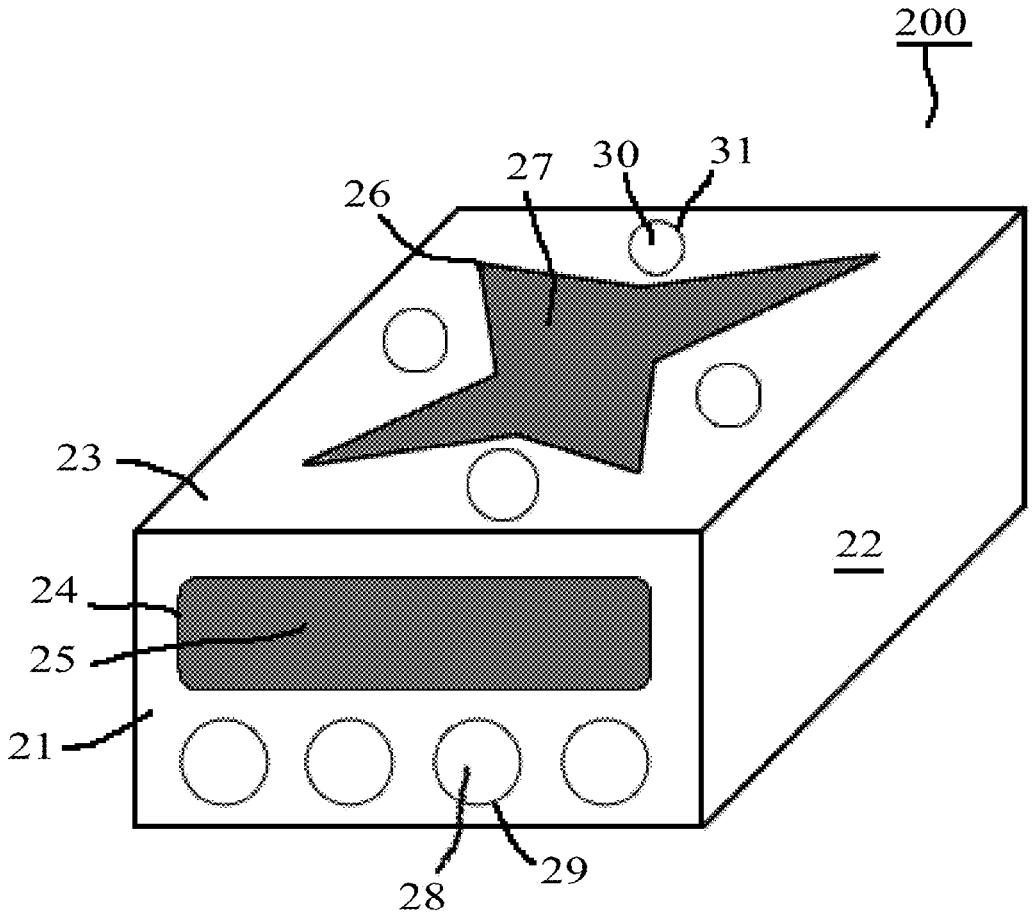
FIG. 2 is a perspective view of a second embodiment of a box of the present invention in a closed position comprising windowed panels and removable tableware in both of said windowed panels.

FIG. 2 shows a perspective view of a second embodiment of a box 200 of the present invention, in a fully closed position, emphasizing windowed panels (shaded regions) which, in this example, comprise a front window 25 and a top window 27. This box 200 comprises two separate pieces, a top piece 200 and a bottom piece (not shown), but an analogous windowed box of the present invention could alternatively comprise a single piece blank. Because it is not essential whether this box 200 is derived from one or from a plurality of pieces, this aspect has not been depicted here in order to simplify the illustration. Only three sides of the top piece of this box 200 are shown, comprising the front panel 21, right panel 22, and top panel 23. It is implied but not shown that the bottom piece of this box 200 comprises a bottom panel and four side panels, although the front side panel of the implied bottom piece would have to be cut in such a way as to permit viewing through the window 25 into the interior of the box 200. The windows 25 and 27 are clear sheets of cellophane glued onto the undersides (i.e., inside surfaces) of panels 21 and 23, respectively, and the boundaries of said windows are defined by holes cut in said panels, where the perimeters of said holes are marked by edges 24 and 26, respectively. Front panel 21 comprises four removable subparts 28 comprising disposable plastic bowls, each of said bowls 28 removably attached along its circumference 29 by an adhesive to panel 21. The orientation of the bowls 28 may be either concave or convex with respect to the outside surface of the box 200; preferably, they are convex, because when they are concave then space must be sacrificed on the inside of the box and/or accommodated within a front side panel of the box to permit the inward protrusion of the bowls from their location panel 21 in such a configuration (not shown). As shown in their convex orientation, the bottoms of the bowls 28 protrude outwards towards the viewer of FIG. 2 (i.e., perpendicularly upwards from the surface of the drawing sheet) relative to the surface of panel 21, while the inside or food-contact surface of the bowls 28 face towards the inside of the box 200. Top panel 23 comprises four circular removable subpanels 30 which serve as flat plates when removed by tearing along perforated score lines 31. Removal of the plates 30 would yield corresponding circular holes in the top panel 23 and said circular holes would have a circumference coterminous with the score lines 31. In preferred embodiments, said holes in top panel 23 can be underlaid with a sheet of cellophane or other material appropriate for forming a window, preferably the same sheet of transparent material spanning the window 27, so that the food contents inside the box 200 are not exposed to the environment when the plates 30 are removed because said sheet 27 attached to the undersurface of top panel 23 effectively provides a sealed covering over said holes, thereby making said holes analogous or equivalent to windows in the shape of said holes, which is more clearly depicted in FIG. 3.

Figure 3:
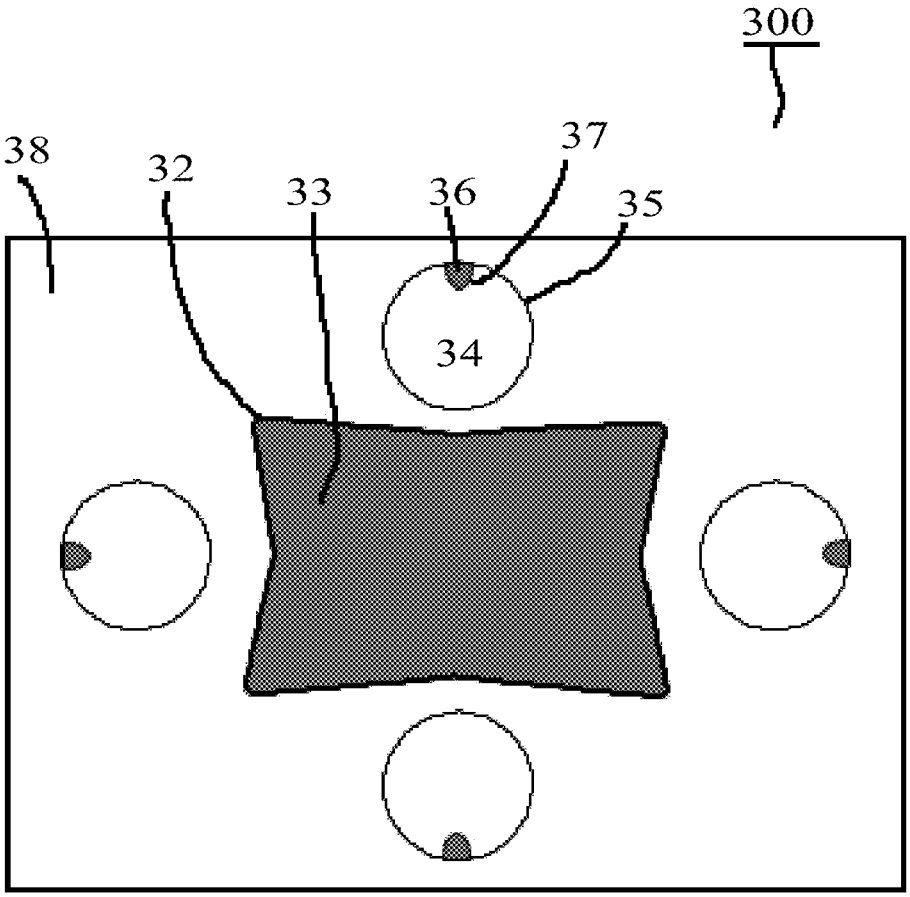
FIG. 3 is a top view of a windowed panel of a box of the present invention showing an accessory feature, thumb holes, in removable subpanels defined by score lines, wherein said thumb holes facilitate the tearing off of each removable subpanel from the box and wherein the cellophane sheet underlying the windowed panel extends beneath the removable subpanels such that the circular holes left behind when each subpanel is removed become circular windows.

FIG. 3 is a top view of a top panel 38 of a box 300 constructed similarly to the box 200 of FIG. 2. The window 33 is a clear sheet of cellophane (shaded regions) glued onto the underside of panel 38, and the perimeter 32 of said window 33 is defined by a hole cut in panel 38. The cellophane sheet comprising window 33 extends to all four edges of panel 38 on the underside (i.e., inside) surface of panel 38 so that said sheet also underlies the four removable circular subparts 34 which serve as flat plates when removed. Thumb holes 36 defined by edges 37 are cut into subparts 34, disrupting the circular shape of the subparts 34, said circular shape being defined by perforations along score lines 35. Each of the thumb holes 36 comprises a cut-away portion of each of said subparts 34, whereby each of the thumb holes 36 reveals a small portion of said underlying cellophane sheet (shaded regions). These thumbholes 36 serve at least two functions. Firstly, they facilitate the user grabbing the edge of each plate 34 to tear it out of panel 38, which is important to prevent undue pressure from puncturing or dislodging the underlying cellophane sheet which would likely occur if a user were not able to find an exposed edge to grasp on each of the plates 34. Secondly, they can serve as convenient handholds for users while they are eating from the removed plates 34.

In order to prevent scoring from excessively weakening the integrity of the box or any of its panels, any embodiments may incorporate discontinuous scoring, a technique known in the art of creating perforated lines in frangible materials, such that score lines are intermittently interrupted by short stretches that are not scored. Thereby the user may tear out a subsection along a score line with substantial ease, but the discontinuity of the score line reduces and the extent to which the integrity of the scored panel is weakened and disrupts the score line along its length such that a crease or a folding is less likely to occur along said line. Methods for creating discontinuous score lines are known in the art; they may include, for example, slit cuts being interrupted about every one-eighth (⅛) to one half (½) inch with uncut span ranging from a few millimeters to about one tenth (1/10) of an inch depending upon the strength, particularly the tear strength, of the box material.

It will be appreciated by those of skill in the art that many other schemes of primary folding lines, score lines, and panel arrangements may be used to construct parent boxes compatible with the present invention. The present invention describes the concept of including removable subpanels comprising tableware in various panels and surfaces of bakery boxes having any size, shape, and configuration. Boxes of the present invention represent convenient, decorative, and thrifty vehicles for the delivery of tableware with food storage containers, while intentionally offering ecological benefits because less material is consumed and less waste is generated when a person serves a food item using the present invention than if a person were to obtain a prior art food storage container and a separate set of disposable tableware. The variety of forms, functions, adornments, embellishments, and materials which can be incorporated into boxes of the present invention adds substantial value to food storage containers when they are considered as products to be sold to bakeries and consumers when compared to the boxes of the prior art. The number, identity, shape, and purposes of the removable subparts may vary considerably between and within embodiments.

The above described embodiments of the present invention exemplify some, but not all, possible implementations of the present invention and have been set forth in order to provide a clear understanding of its qualities. Those skilled in the art will appreciate that the conception upon which this disclosure is based may readily be utilized as a basis for designing of other structures, methods, and systems for carrying out the several purposes of the present invention. The following claims should be regarded as encompassing equivalent and various constructions insofar as they do not depart from the spirit and scope of the methods and devices consistent with the present invention.

I claim:

1. A bakery box comprising:

at least three adjacently attached structural panels arranged substantially contiguously to define an enclosed interior space for storing food, said structural panels comprising a top panel, a bottom panel, and at least one side panel, wherein at least one of said structural panels further comprises an access opening that can be reversibly opened and closed to regulate access to the interior space, whereby said box, when the access opening is closed, provides a substantially continuous protective barrier around the interior space such that the direct passage of solid matter into and out of the box is substantially precluded, and, wherein one or more of said structural panels further comprises one or more adjacently attached structurally superfluous panels not essential to providing said protective barrier, such that said superfluous panels may be removed from the box without causing a breach in the protective barrier, wherein said breach permits the unimpeded passage of solid matter across the protective barrier; and, wherein said superfluous panels comprise removable subpanels comprising tableware; and, wherein the removable subpanels comprising tableware are manufactured separately from the superfluous panels and are composed of materials different from the superfluous panels.

2. A bakery box comprising:

at least three adjacently attached structural panels arranged substantially contiguously to define an enclosed interior space for storing food, said structural panels comprising a top panel, a bottom panel, and at least one side panel, wherein at least one of said structural panels further comprises an access opening that can be reversibly opened and closed to regulate access to the interior space, whereby said box, when the access opening is closed, provides a substantially continuous protective barrier around the interior space such that the direct passage of solid matter into and out of the box is substantially precluded, and, wherein one or more of said structural panels further comprises one or more adjacently attached structurally superfluous panels not essential to providing said protective barrier, such that said superfluous panels may be removed from the box without causing a breach in the protective barrier, wherein said breach permits the unimpeded passage of solid matter across the protective barrier; and, wherein said superfluous panels comprise removable subpanels comprising tableware; and, wherein the removable subpanels further comprise one or more decorative elements, said decorative elements comprising paints, dyes, sealants, textures, indicia, chemical coatings, or any other means for applying artistic expression to tableware.

3. A bakery box comprising:

at least three adjacently attached structural panels arranged substantially contiguously to define an enclosed interior space for storing food, said structural panels comprising a top panel, a bottom panel, and at least one side panel, wherein at least one of said structural panels further comprises an access opening that can be reversibly opened and closed to regulate access to the interior space, whereby said box, when the access opening is closed, provides a substantially continuous protective barrier around the interior space such that the direct passage of solid matter into and out of the box is substantially precluded, and, wherein one or more of said structural panels further comprises one or more adjacently attached structurally superfluous panels not essential to providing said protective barrier, such that said superfluous panels may be removed from the box without causing a breach in the protective barrier, wherein said breach permits the unimpeded passage of solid matter across the protective barrier; and, wherein said superfluous panels comprise removable subpanels comprising tableware; and, wherein at least one of the structurally superfluous panels comprises a compound panel to provide an increased total surface area for accommodating an additional population of said removable subpanels, said compound panel comprising a plurality of folded layers adjacently stacked together in a substantially parallel alignment with one or more of any panels of the box, but wherein said compound panel may be unfolded and extended when desirable for the removal of any of said additional population of said removable subpanels.

4. The box of claim 3, further comprising one or more windows, said one or more windows comprising a substantially transparent sheet occupying and spanning an excised region of one or more of any panels of the box, wherein said sheet is fixedly attached to said one or more panels such that said excised region is sufficiently covered and sealed by said sheet to preserve said substantially continuous protective barrier, and whereby said one or more windows permit a person to view the interior space of the box while the box is closed.

5. The box of claim 4, comprising one or more removable window-covering subpanels, wherein said one or more removable window-covering subpanels cover at least a portion of said substantially transparent sheet, such that removing any of said one or more removable window-covering subpanels yields a newly-formed window that permits a person to view the interior space of the box while the box is closed, and wherein said one or more removable window-covering subpanels comprise tableware.

6. The box of claim 5, wherein the one or more removable window-covering subpanels are defined by score lines and are removable by tearing, cutting, or any other means for dividing materials along score lines.

7. The box of claim 5, wherein the one or more removable window-covering subpanels comprise plates, bowls, or any other dishes for serving food.

8. The box of claim 5, further comprising bamboo, balsa, or any other lightweight wood.

9. The box of claim 5, wherein the one or more removable window-covering subpanels further comprise one or more thumb holes for facilitating the removal of said one or more removable window-covering subpanels from the box.

10. The box of claim 5, wherein the one or more removable window-covering subpanels further comprise one or a plurality of decorative elements, said decorative elements comprising paints, dyes, sealants, textures, indicia, chemical coatings, or any other means for applying artistic expression to tableware.

11. The box of claim 3, wherein the removable subpanels comprise plates, bowls, or any other dishes for serving food.

12. The box of claim 3, further comprising bamboo, balsa, or any other lightweight wood.

13. The box of claim 3, wherein the removable subpanels comprise one or more thumb holes for facilitating the removal of said removable subpanels from the box.

14. The box of claim 3, wherein the access opening comprises a means for reversibly fastening the box in the closed position.

15. A bakery box comprising:

at least three adjacently attached structural panels arranged substantially contiguously to define an enclosed interior space for storing food, said structural panels comprising a top panel, a bottom panel, and at least one side panel, wherein at least one of said structural panels further comprises an access opening that can be reversibly opened and closed to regulate access to the interior space, whereby said box, when the access opening is closed, provides a substantially continuous protective barrier around the interior space such that the direct passage of solid matter into and out of the box is substantially precluded, and, wherein one or more of said structural panels further comprises one or more adjacently attached structurally superfluous panels not essential to providing said protective barrier, such that said superfluous panels may be removed from the box without causing a breach in the protective barrier, wherein said breach permits the unimpeded passage of solid matter across the protective barrier; and, wherein said superfluous panels comprise removable subpanels comprising tableware; and, further comprising one or more windows, said one or more windows comprising a substantially transparent sheet occupying and spanning an excised region of one or more of any panels of the box, wherein said sheet is fixedly attached to said one or more panels such that said excised region is sufficiently covered and sealed by said sheet to preserve said substantially continuous protective barrier, and whereby said one or more windows permit a person to view the interior space of the box while the box is closed; and, comprising one or more removable window-covering subpanels, wherein said one or more removable window-covering subpanels cover at least a portion of said substantially transparent sheet, such that removing any of said one or more removable window-covering subpanels yields a newly-formed window that permits a person to view the interior space of the box while the box is closed, and wherein said one or more removable window-covering subpanels comprise tableware; and, wherein the one or more removable window-covering subpanels are:

manufactured separately from the one or more panels to which the substantially transparent sheet is fixedly attached, and composed of materials different from the one or more panels to which the substantially transparent sheet is fixedly attached.

* * * * *